US008708459B2

(12) United States Patent
Nishimura et al.

(10) Patent No.: US 8,708,459 B2
(45) Date of Patent: Apr. 29, 2014

(54) DROPLET EJECTION HEAD, METHOD OF MANUFACTURING DROPLET EJECTION HEAD, AND DROPLET EJECTION APPARATUS

(75) Inventors: Hideaki Nishimura, Kanagawa (JP); Yukitoshi Tajima, Kanagawa (JP); Mitsuya Matsubara, Kanagawa (JP); Masaki Kato, Tokyo (JP); Kiyoshi Yamaguchi, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 13/554,318

(22) Filed: Jul. 20, 2012

(65) Prior Publication Data

US 2013/0021412 A1 Jan. 24, 2013

(30) Foreign Application Priority Data

Jul. 21, 2011 (JP) ..... 2011-160185

(51) Int. Cl.
*B41J 2/14* (2006.01)

(52) U.S. Cl.
USPC ..... 347/49; 347/87; 347/86

(58) Field of Classification Search
USPC ..... 347/49, 19, 87, 86; 29/890.1
See application file for complete search history.

(56) References Cited

U.S. PATENT DOCUMENTS 6,350,013 B1 * 2/2002 Scheffelin et al. ..... 347/49
7,427,332 B2 * 9/2008 Takemoto et al. ..... 156/275.5

FOREIGN PATENT DOCUMENTS

| | | |
|---|---|---|
| JP | 2698638 | 9/1997 |
| JP | 2001-158088 | 6/2001 |
| JP | 3495938 | 11/2003 |
| JP | 2010-280096 | 12/2010 |

* cited by examiner

*Primary Examiner* — Henok Legesse
(74) *Attorney, Agent, or Firm* — Oblon, Spivak, McClelland, Maier & Neustadt, L.L.P.

(57) ABSTRACT

A droplet ejection head that is attachable to and removable from a droplet ejection apparatus, includes: a nozzle plate having multiple nozzle holes to eject droplets; an individual-channel substrate in which multiple individual-liquid-chambers to supply liquid to the nozzle holes are formed; a common-channel substrate to supply liquid to the individual-channel substrate; a base plate made of metal and including a first positioning part to be engaged with a part of the droplet ejection apparatus at a given position to perform positioning with respect to the droplet ejection apparatus in a direction along an opening surface of the nozzle plate at which the nozzle holes are opened; and a housing made of resin and including a second positioning part to perform positioning with respect to the droplet ejection apparatus in a direction intersecting with the opening surface.

8 Claims, 7 Drawing Sheets

DROPLET EJECTION HEAD, METHOD OF MANUFACTURING DROPLET EJECTION HEAD, AND DROPLET EJECTION APPARATUS

CROSS-REFERENCE TO RELATED APPLICATIONS

The present application claims priority to and incorporates by reference the entire contents of Japanese Patent Application No. 2011-160185 filed in Japan on Jul. 21, 2011.

BACKGROUND OF THE INVENTION

1. Field of the Invention

The present invention relates to a droplet ejection head that ejects droplets to form an image on a recording paper sheet, a method of manufacturing a droplet ejection head, and a droplet ejection apparatus.

2. Description of the Related Art

The droplet ejection head (inkjet head) in a droplet ejection apparatus, such as an inkjet recording apparatus, that is used as an image recording apparatus or an image forming apparatus, such as a printer, a facsimile machine, or a copy machine, includes a nozzle to eject ink droplets; a pressure chamber (also referred to as an ink flow channel, a pressurizing liquid chamber, a pressurizing chamber, an ejection chamber, or a liquid chamber) communicating with the nozzle; and an electromechanical conversion element, such as an piezoelectric element, (or an electro-thermal conversion element, such as a heater) that applies pressure to the ink in the pressure chamber. In the droplet ejection head, a diaphragm is displaced using the energy generated by applying a voltage to the electromechanical conversion element to apply pressure to the ink in the pressure chamber so as to eject the ink droplets from the nozzle, thereby an image is formed on a recording paper sheet.

In such an inkjet recording apparatus, one or more inkjet heads to perform printing on a recording paper sheet are mounted on a carriage that is moved back and forth in a direction orthogonal to a direction in which the recording paper sheet is conveyed. The inkjet recording apparatus may have a configuration in which the inkjet head is attachable to and removable from the carriage. Making the inkjet head attachable to and removable from a given part of the carriage in the inkjet recording apparatus has advantages of reducing costs because it makes assembly easier during manufacturing and of improving appliance performance (ease of handling) when a user replaces the inkjet head.

In such an inkjet recording apparatus, in order to ensure the printing quality, i.e., in order to cause ink droplets to reach the recording paper sheet with high positioning accuracy, it is required to engage the inkjet head, including a base plate having a position reference surface that has improved accuracy, with a part of the inkjet recording apparatus at a given position. Furthermore, in accordance with a demand for a high image resolution in recent years, it is required to arrange nozzle holes and elements in a high density and it is also required to improve the accuracy of positioning the inkjet head with respect to the inkjet recording apparatus.

Thus, an inkjet recording head has been disclosed in which a position reference surface serving as a reference surface for a position at which the inkjet head is attached to the inkjet recording apparatus is formed of resin and the inkjet head is engaged with a part of the inkjet recording apparatus at a given position, thereby the accuracy of attaching the inkjet head to the inkjet recording apparatus is improved (see Japanese Patent No. 3495938).

Furthermore, an inkjet recording head has been disclosed in which a thermoplastic resin, such as poly phenylene sulfide (PPS) or poly phenylene ether (PPE) containing 80 wt % or more of fillers, is used as resin from which a support member having a position reference surface (reference surface) is formed, thereby the rigidity of the position reference surface is increased (see, Japanese Patent Application Laid-open No. 2010-280096).

Furthermore, a recording head cartridge incorporating an ink tank has been disclosed in which a base plate provided with a reference surface is formed of metal, such as aluminum, and the cartridge and the recording head are positioned only with respect to the base plate, whereby highly-accurate positioning can be performed (see, Japanese Patent No. 2698638).

However, when resin is used to form the position reference surface of the inkjet head as in the inkjet recording head of Japanese Patent No. 3495938, the position reference surface may deform due to insufficient rigidity or the size accuracy of the position reference surface may reduce by deformation of the position reference surface due to its insufficient rigidity or by the effect of thermal deformation of the member resulting from the change in environmental temperature due to the transport environment, etc., and accordingly the accuracy of positioning the inkjet head with respect to the inkjet recording apparatus may be reduced. This leads to a problem in that the accuracy with which ink droplets from the inkjet head reach the correct position on the recording paper sheet reduces, which reduces the image quality provided by the inkjet recording apparatus.

When a resin contains a large volume of fillers of 80 wt % as in the inkjet recording head of the Japanese Patent Application Laid-open No. 2010-280096, the manufacturing cost increases due to abrasion of a mold used in molding. There is also a problem in that the dust caused by the fillers and generated from the base plate reduces the ejection performance, which reduces the image quality.

When all position reference surfaces are provided only on a metallic base plate as in the recording head cartridge incorporating the ink tank, there is a problem in that, because the shape of the base plate is complicated, the accuracy of positioning the cartridge and the recording unit of the recording head with respect to each other is reduced and the cost of manufacturing increases.

There is a need to provide a droplet ejection head, a method of manufacturing a droplet ejection head, and a droplet ejection apparatus that improve the accuracy of positioning a droplet ejection head with respect to a droplet ejection apparatus when the droplet ejection head is attached to the droplet ejection apparatus, that improve the image quality, and that reduces the cost of manufacturing the droplet ejection head.

SUMMARY OF THE INVENTION

It is an object of the present invention to at least partially solve the problems in the conventional technology.

A droplet ejection head that is attachable to and removable from a droplet ejection apparatus. The droplet ejection head includes: a nozzle plate having multiple nozzle holes to eject droplets; an individual-channel substrate in which multiple individual-liquid-chambers to supply liquid to the nozzle holes are formed, the individual-channel substrate including pressure generating units that apply pressure to liquid in the individual-liquid-chambers; a common-channel substrate to supply liquid to the individual-channel substrate; a base plate made of metal and including a first positioning part to be engaged with a part of the droplet ejection apparatus at a given position to perform positioning with respect to the droplet ejection apparatus in a direction along an opening surface of the nozzle plate at which the nozzle holes are opened; and a housing made of resin and including a second positioning part to perform positioning with respect to the droplet ejection apparatus in a direction intersecting with the opening surface.

A method of manufacturing a droplet ejection head that is attachable to and removable from a droplet ejection apparatus and that includes: a nozzle plate having multiple nozzle holes to eject droplets; an individual-channel substrate in which multiple individual-liquid-chambers to supply liquid to the nozzle holes are formed, the individual-channel substrate including pressure generating units that apply pressure to liquid in the individual-liquid-chambers; a common-channel substrate to supply liquid to the individual-channel substrate; a base plate made of metal and including a first positioning part to be engaged with a part of the droplet ejection apparatus at a given position to perform positioning with respect to the droplet ejection apparatus in a direction along an opening surface of the nozzle plate at which the nozzle holes are opened; and a housing made of resin and including a second positioning part to perform positioning with respect to the droplet ejection apparatus in a direction intersecting with the opening surface. The method includes: a first step of manufacturing a first head structure by optically aligning and joining the nozzle plate and the individual-channel substrate; a second step of manufacturing a second head structure by aligning, using an opening provided in the common-channel substrate and the base plate, and joining the common-channel substrate and the base plate; and a third step of optically aligning and joining the first head structure and the second head structure.

A droplet ejection apparatus includes an attachable and removable droplet ejection head. The droplet ejection head includes: a nozzle plate having multiple nozzle holes to eject droplets; an individual-channel substrate in which multiple individual-liquid-chambers to supply liquid to the nozzle holes are formed, the individual-channel substrate including pressure generating units that apply pressure to liquid in the individual-liquid-chambers; a common-channel substrate to supply liquid to the individual-channel substrate; a base plate made of metal and including a first positioning part to be engaged with a part of the droplet ejection apparatus at a given position to perform positioning with respect to the droplet ejection apparatus in a direction along an opening surface of the nozzle plate at which the nozzle holes are opened; and a housing made of resin and including a second positioning part to perform positioning with respect to the droplet ejection apparatus in a direction intersecting with the opening surface.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Best modes of a droplet ejection head, a method of manufacturing a droplet ejection head, and a droplet ejection apparatus according to the present invention will be described in detail below with reference to the accompanying drawings.

Figure 1:
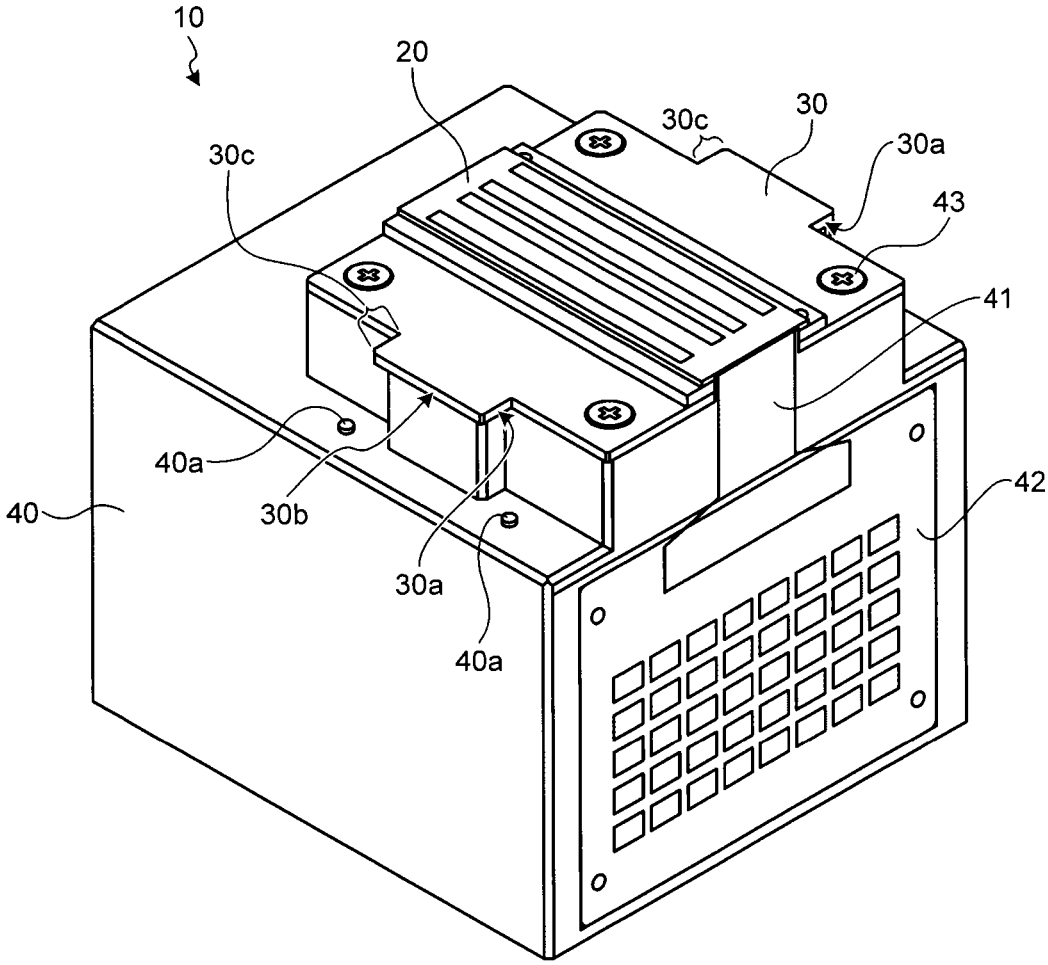
FIG. 1 is a perspective view of an inkjet head according to an embodiment.
Figure 2:
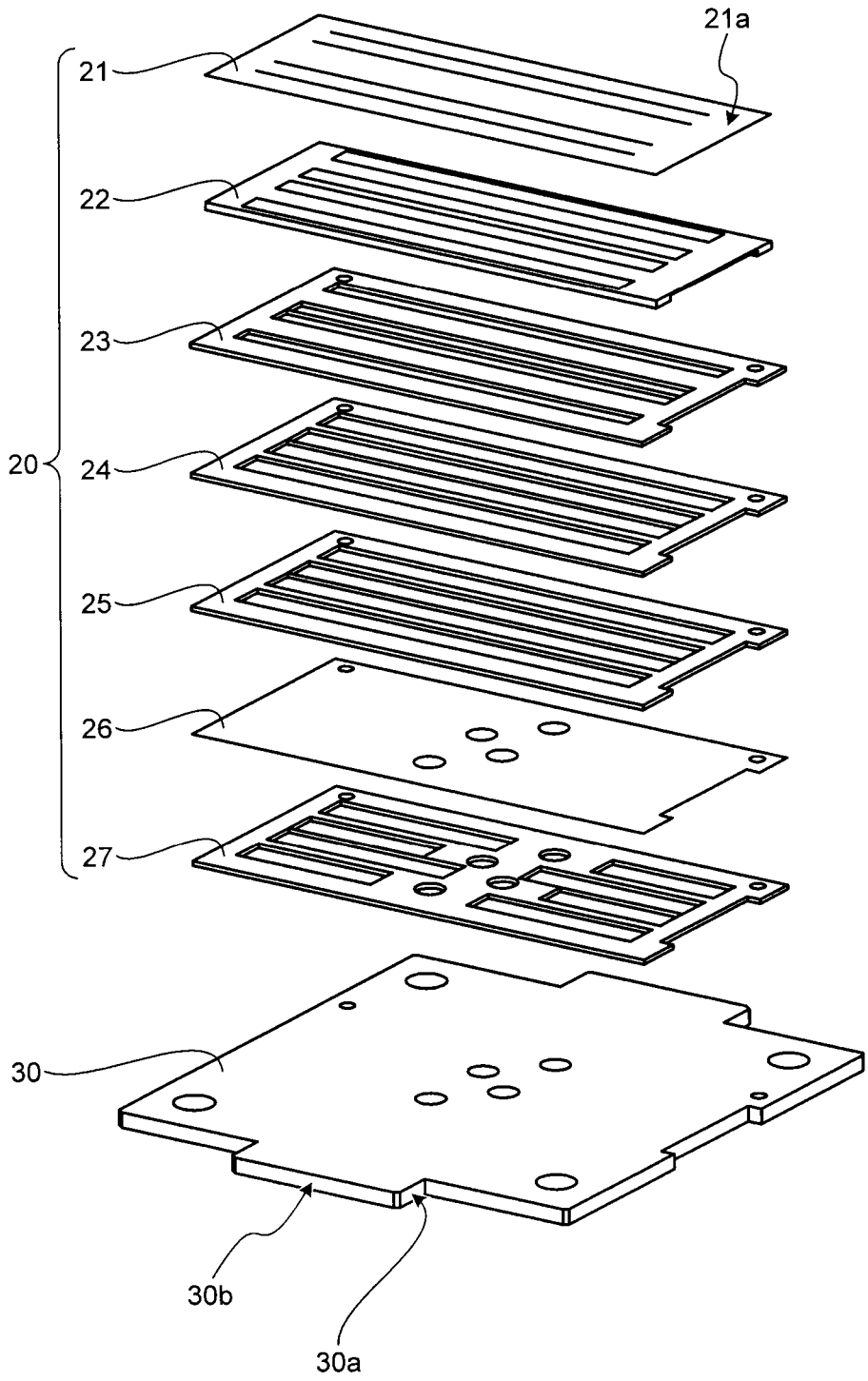
FIG. 2 is an exploded perspective view of the members of the inkjet head.

FIG. 1 is a perspective view of an inkjet head according to an embodiment. FIG. 2 is an exploded perspective view of members of the inkjet head.

The inkjet head 10 according to the present embodiment mainly includes an inkjet head chip 20, a base plate 30, a housing 40, a connector substrate 42, and a flexible printed circuit (FPC) 41, which are superposed on each other.

The inkjet head chip 20 ejects ink droplets to form an image on a recording paper sheet. As shown in FIG. 2, the inkjet head chip 20 includes a nozzle plate 21, an individual-channel substrate 22, common-channel substrates 23, 24, and 25, and damper members 26, 27.

In the nozzle plate 21, four nozzle arrays each composed of multiple ink ejection ports (nozzle holes) from which ink droplets are ejected are formed.

In the individual-channel substrate 22, multiple individual-liquid-chambers from each of which ink is supplied to corresponding one of the ink ejection ports. The individual-channel substrate 22 includes electromechanical conversion elements each provided on one of diaphragms that each applies pressure to one of the individual-liquid-chambers, and each including a lower electrode, a piezoelectric element, and an upper electrode.

In the common-channel substrates 23 to 25, multiple common-channels and common-liquid-chambers through which ink is supplied to each of the individual-liquid-chambers. In the present embodiment, the common-channel substrates form the common-channels and the common-liquid-chambers. However, a configuration may be used in which a single common-channel substrate forms the common-channels and the common-liquid-chambers.

The damper members 26 and 27 serve to reduce residual oscillations in the fluid in the common-liquid-chambers.

The inkjet head chip 20 includes electromechanical conversion elements, which are pressure generating units, and ink supply pathways for each of the nozzle arrays of the nozzle plate 21, and thus the inkjet head chip 20 is configured to be capable of ejecting ink droplets of four colors with a single chip. Because the electromechanical conversion elements according to the present embodiment are formed by a deposition method using a sol-gel method and by a semiconductor process, a dense device can be easily formed.

The sol-gel method is a method of preparing an inorganic oxide in which a metal organic compound, such as a metal alkoxide, is hydrolyzed and polycondensated with a solution system to develop a metallic bond of metal and oxygen, and the inorganic oxide is completed through final sintering. Specifically, as the piezoelectric material that is deposited through the sol-gel method, can be used a lead zirconate titanate (PZT) based material obtained by dissolving lead acetate, isopropoxide zirconium, and isopropoxide titanium, which are used as starting materials, in methoxyethanol, serving as the common solvent.

The base plate 30 is formed of metal. The base plate 30 is removably engaged with a given part of the inkjet recording apparatus. The base plate 30 includes a positioning part to perform positioning with respect to the inkjet recording apparatus in a direction along an opening surface 21*a* in which the nozzle ejection ports of the nozzle plate 21 are opened. In the present embodiment, in the base plate 30, position reference surfaces 30*a* and 30*b* to perform positioning in the direction parallel to the opening surface 21*a* of the nozzle plate 21 are formed.

The position reference surfaces 30*a* and 30*b* are provided in the direction intersecting with the nozzle arrays, which are formed in the nozzle plate 21, on a protrusion protruding from an edge of the base plate 30 along the nozzle arrays. In the present embodiment, the position reference surfaces 30*a* and 30*b* are formed in a direction orthogonal to the nozzle arrays formed in the nozzle plate 21 and on protrusions 30*c* protruding from both edges of the base plate 30. When the inkjet head 10 is attached to the inkjet recording apparatus, side surfaces of the base plate 30, i.e., surfaces perpendicular to the opening surface 21*a* of the nozzle plate 21, engage with the inkjet recording apparatus at given positions. The position reference surfaces 30*a* and 30*b* of the present embodiment are formed in the direction orthogonal to the nozzle arrays. However, a configuration may be used in which the position reference surfaces 30*a* and 30*b* are formed in a direction in which they intersect with, but are not orthogonal to, the nozzle arrays.

As described above, in the inkjet head 10 according to the present embodiment, the position reference surfaces 30*a* and 30*b* to perform positioning in the direction parallel to the opening surface 21*a* of the nozzle plate 21, to which high accuracy is required, are provided on the base plate 30 close to the ink ejection ports and the base plate 30 is formed of metal, which thus improves accuracy of positioning the inkjet head 10 with respect to the carriage of the inkjet recording apparatus.

The housing 40 is formed of resin. The housing 40 holds the base plate 30 and an ink tank (not shown). The housing 40 includes a positioning part to perform positioning with respect to the inkjet recording apparatus in a direction intersecting with the opening surface 21*a* of the nozzle plate 21. In the present embodiment, the housing 40 includes position reference surfaces 40*a* to perform positioning with respect to the inkjet recording apparatus in the direction (height direction) perpendicular to the opening surface 21*a* of the nozzle plate 21. As shown in FIG. 1, the position reference surface 40*a* is a surface of a protrusion that protrudes from an upper surface of the housing 40. The position reference surfaces 40*a* of the present embodiment are to perform positioning in the direction perpendicular to the opening surface 21*a* of the nozzle plate 21. However, a configuration may be used in which positioning is performed in a direction intersecting with, but not perpendicular to, the opening surface 21*a*.

In this way, in the inkjet head 10 according to the present embodiment, the housing 40 including the position reference surfaces 40*a* to perform positioning in the direction perpendicular to the opening surface 21*a* of the nozzle plate 21, to which accuracy is not required compared to the positioning in the direction parallel to the opening surface 21*a* of the nozzle plate 21, is formed of resin, which reduces the cost of manufacturing the inkjet head 10.

The connector substrate 42 is electrically connected to a connector (not shown) of the inkjet recording apparatus. The connector substrate 42 includes multiple electric pads that transmit electric signals depending on the image to be recorded.

The FPC 41 electrically connects a pad part (not shown) of the inkjet head chip 20 and the connector substrate 42.

The above-described configuration of the inkjet head 10 allows the position reference surfaces 30*a* and 30*b* formed of metal to be engaged with the carriage of the inkjet recording apparatus at given positions (position reference surfaces), which improves the accuracy of positioning with respect to a direction in which a recording paper sheet is conveyed.

When the inkjet head 10 is attached to the inkjet recording apparatus and printing is performed, electric signals depending on an image to be recorded are transmitted from the inkjet recording apparatus, the electric signals are then supplied via the connector substrate 42 and the FPC 41 to the electromechanical conversion elements, mechanical vibration converted by the electromechanical conversion elements applies pressure to the ink in the individual chambers via the diaphragm, and thus the ink is ejected from the nozzle ejection ports to the recording paper sheet. As described above, improvement in the positioning accuracy when the inkjet head 10 is attached improves the accuracy of the ejection of the ink from the nozzle ejection ports onto the recording paper sheet, and thereby it is possible to improve the image quality.

The method of manufacturing the inkjet head 10 will be described here. FIGS. 3A, 3B, 3C, and 3D are exploded perspective views schematically showing the process of manufacturing an inkjet head according to the present embodiment.

A first head structure 61, a second head structure 62, and a third head structure 63 of the inkjet head 10 will be described separately below. The first head structure 61 includes the nozzle plate 21, the individual-channel substrate 22 including the pressure generating units, and the FPC 41 that is connected to the pad part (not shown) on the individual-channel substrate 22. The second head structure 62 includes the common-channel substrates 23 to 25, the damper members 26 to 27, and the base plate 30. The third head structure 63 includes the housing 40, a sealing member 44, and the connector substrate 42. First, each of the head structures and the method of manufacturing thereof will be described below.

Figure 3A:
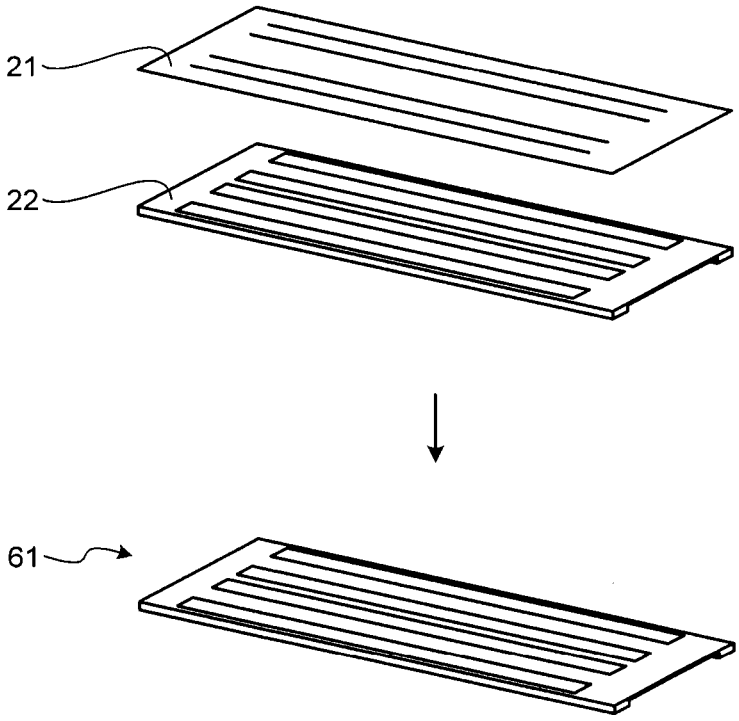
FIG. 3A is an exploded perspective view schematically illustrating a process of manufacturing the inkjet head according to the embodiment.

The nozzle plate 21 is formed of a metal material, such as SUS, Ni, or Fe—Ni alloy. In the individual-channel substrate 22, the individual-channel, the diaphragm, and the electromechanical conversion element are formed on a Si substrate using a semiconductor process. As shown in FIG. 3A, the first head structure 61 is joined by performing an alignment by optically observing an alignment pattern on the individual-channel substrate 22 via an alignment opening formed in the nozzle plate 21 and by compressing and heating via an adhesive previously applied over a surface of the individual-channel substrate 22.

As the adhesive, an adhesive that is highly resistant to being dissolved in the ink used for the inkjet recording apparatus, particularly, a thermosetting resin (epoxy adhesive) mainly composed of, for example, an epoxy resin, can be preferably used.

The second head structure 62 will be described here. The common-channel substrates 23 to 25, the damper members 26 and 27, and the base plate 30 of the second head structure 62 are formed in a shape of a flat plate using a metal material, such as SUS or an Fe—Ni alloy, and the outer shape and the pin alignment holes are defined by a press working method (press molding). Further, the common-channel is formed in the common-channel substrates 23 to 25 by a press working method.

Figure 3B:
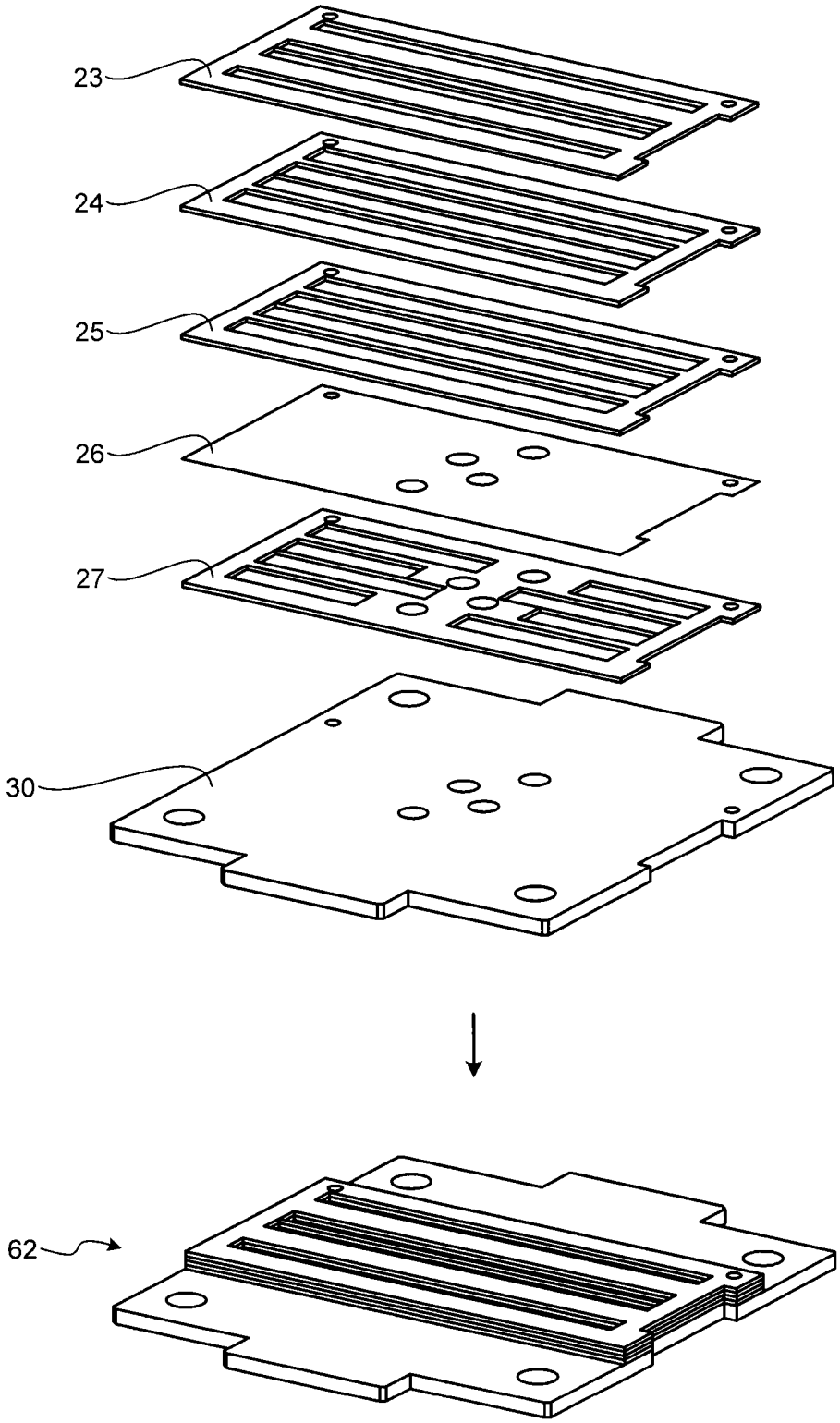
FIG. 3B is an exploded perspective view schematically illustrating the process of manufacturing the inkjet head according to the embodiment.

As shown in FIG. 3B, in the second head structure 62, the common-channel substrates 23 to 25, the damper members 26 and 27, and the base plate 30 are joined via an epoxy adhesive previously applied thereover while sequentially superposing the common-channel substrates 23 to 25 on a joining jig (not shown) to which a pin is inserted, and applying compression and heat thereto. Because elements of the second head structure 62 of the present embodiment are formed in the shape of the flat plate using the same type of metal material as described above, molding is easy and, even when a heating process for integration joining is performed, high size accuracy can be obtained without warping due to difference in thermal expansion being caused.

Figure 3C:
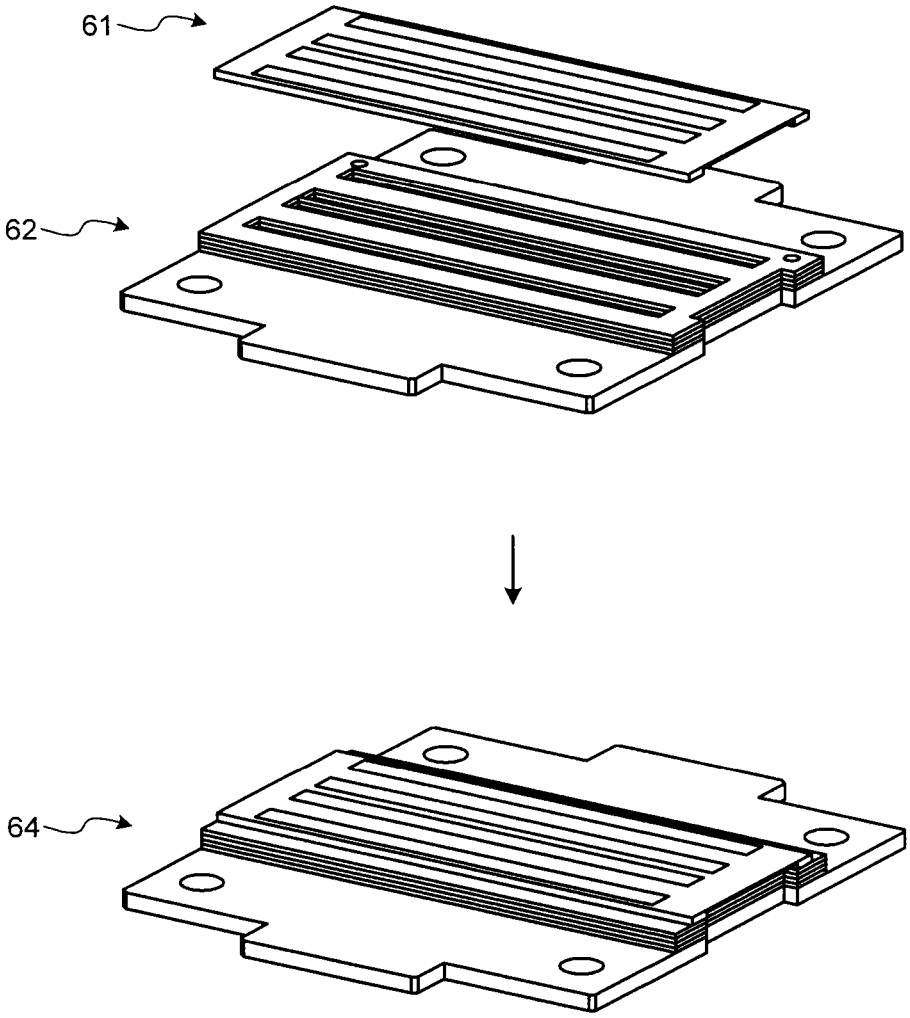
FIG. 3C is an exploded perspective view schematically illustrating the process of manufacturing the inkjet head according to the embodiment.
Figure 3D:
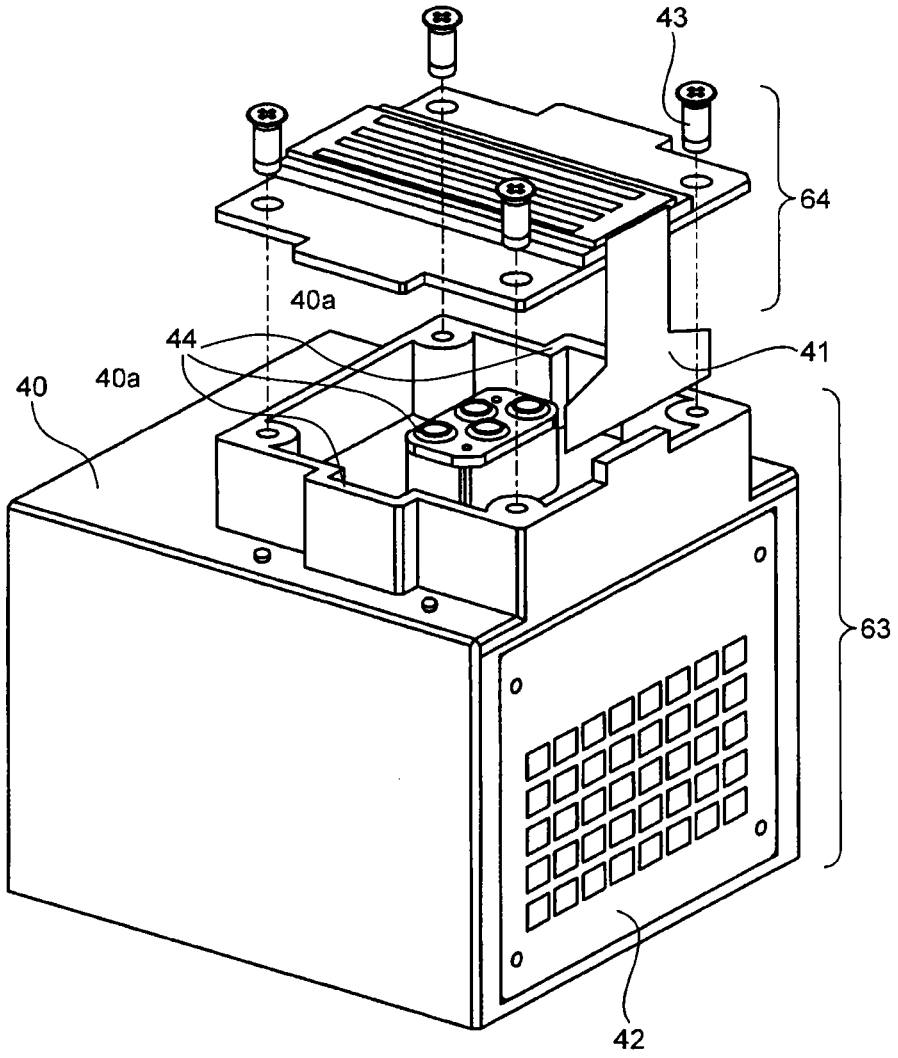
FIG. 3D is an exploded perspective view schematically illustrating the process of manufacturing the inkjet head according to the embodiment.

The third head structure 63 will be described here. The housing 40 is formed using a molding method. As shown in FIG. 3D, the connector substrate 42 is fixed to the housing 40 by adhesion and the sealing member 44 is inserted into the ink supply port of the housing 40, thereby the third head structure 63 is manufactured. As the sealing member 44, an elastic member that is highly resistant to being dissolved in the ink used for the inkjet recording apparatus, particularly, a silicone rubber or ethylene propylene rubber (EPDM) can be preferably used.

The method of superposing the head structures will be described below. First, as shown in FIG. 3C, the alignment opening provided on a surface of the nozzle plate 21 and the base plate 30 are optically aligned and then compression and heat are applied to join the first head structure 61 and the second head structure 62 via the adhesive applied over surfaces to be joined. The structure obtained by joining the first head structure 61 and the second head structure 62 is referred to as a fourth head structure 64.

In this way, in the fourth head structure 64 according to the present embodiment, the base plate 30, having the position reference surfaces 30*a* and 30*b*, and the first head structure 61, having the nozzle plate 21, are closely positioned, and thus optical alignment with improved accuracy can be easily performed.

As shown in FIG. 3D, the fourth head structure 64 and the third head structure 63 are joined using fasteners 43 via the sealing member 44. The joining with the fasteners 43 is made without using adhesive, thereby requiring no heating process. Accordingly, in the joining of the housing 40 formed of resin and the base plate 30 formed of metal, deterioration in the positioning accuracy resulting from any thermal expansion difference can be prevented and easy assembling can be performed.

The method of manufacturing an inkjet head according to the present embodiment can improve the alignment accuracy as described above and, because each of the structures can be formed using one of parallel production equipments, can shorten the time required for manufacturing and thus reduce the cost of manufacturing.

Figure 4:
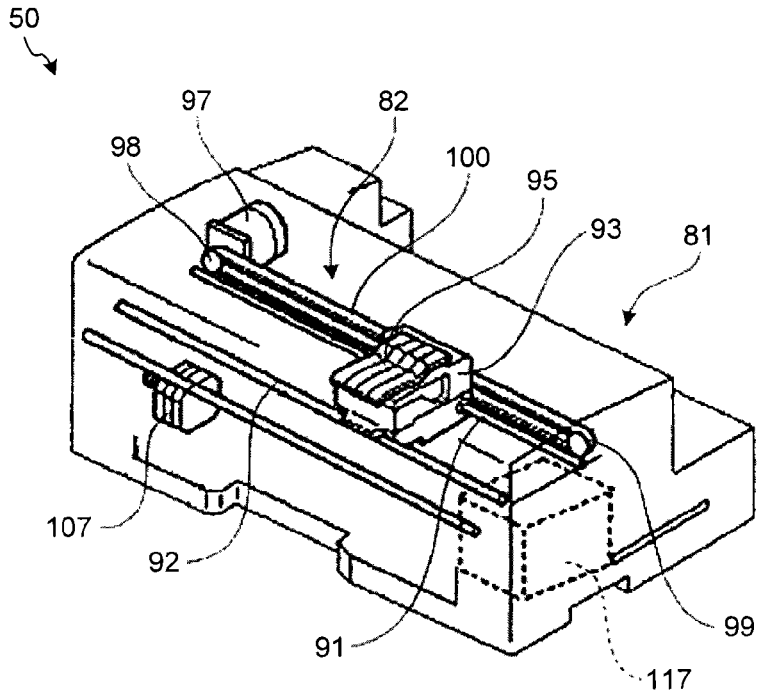
FIG. 4 is a perspective view of an inkjet device.
Figure 5:
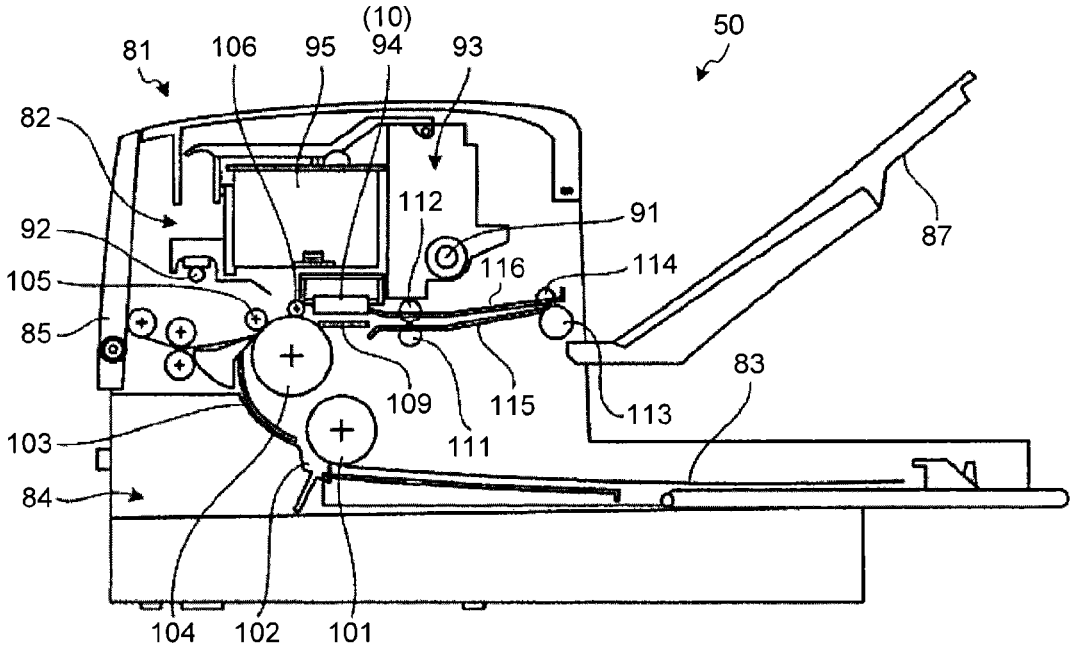
FIG. 5 is a cross-sectional view of the inkjet device.

An example of a method of manufacturing the inkjet head 10 according to the present embodiment will be described with reference to FIGS. 4 and 5. FIG. 4 is a perspective view of the inkjet recording apparatus. FIG. 5 is a cross-sectional view of the inkjet recording apparatus.

As shown in FIGS. 4 and 5, an inkjet recording apparatus 50 houses, in a recording apparatus body 81, a carriage 93 movable in a main scanning direction; a recording head 94 mounted on the carriage 93 and including the inkjet head 10; and a printing mechanism 82 including an ink cartridge 95 to supply ink to the recording head 94. At a lower part of the recording apparatus body 81, from the front, a paper cassette 84 (or a sheet feed tray) on which a large number of paper sheets 83 can be stacked is removably attached and a manually feed tray 85 to manually feed the paper sheet 83 can be opened to rotate down. After the paper sheet 83 supplied from the paper cassette 84 or the manually feed tray 85 is taken in and the printing mechanism records the required image, the paper sheet 83 is ejected to an ejected sheet tray 87 attached to the back side.

In the printing mechanism 82, a main guiding rod 91 and a sub guiding rod 92 that are guiding members supported at their both sides by right and left side plates (not shown) hold the carriage 93 slidably in the main scanning direction. The recording head 94, that includes a droplet ejection head formed by the above-described thin film formation and that ejects ink droplets of yellow (Y), cyan (C), magenta (M), and black (Bk), is mounted on the carriage 93 such that the ejection ports (nozzles) are arrayed in a direction intersecting with the main scanning direction and a direction in which the ink droplets are ejected from the ejection ports is oriented downward. Ink cartridges 95 to supply the ink of respective colors to the recording head 94 are replaceably attached to the carriage 93.

The ink cartridge 95 has an atmosphere port in an upper part to communicate with the atmosphere, a supply port in a lower part to supply the ink to the inkjet head, and a porous member in the inside that is filled with ink. The capillary force of the porous member keeps the ink supplied to the recording head 94 at a slightly negative pressure. The heads of respective colors are used for the recording head 94 here. Alternatively, a single head including nozzles that eject ink droplets of the respective colors may be used.

A back part (sheet conveying direction downstream part) of the carriage 93 is slidably fitted to the main guiding rod 91 and a front part (sheet conveying direction upstream part) of the carriage 93 is slidably put on the sub guiding rod 92. In order to cause the carriage 93 to move and scan in the main scanning direction, a timing belt 100 is extended between a drive pulley 98, that is rotated by a main scanning motor 97, and a driven pulley 99, and the timing belt 100 is fixed to the carriage 93 so that the carriage 93 moves back and forth in response to the forward/reverse rotation of the main scanning motor 97.

In order to convey the paper sheet 83 set in the paper cassette 84 to a position under the recording head 94, the following are provided: a paper feeding roller 101 and a friction pad 102 that separate and feed the paper sheet 83 from the paper cassette 84; a guide member 103 that guides the paper sheet 83; a conveyor roller 104 that inverts and conveys the fed paper sheet 83; and a tip roller 106 that regulates an angle at which the paper sheet 83 from the conveyor roller 104 and a conveyor roller 105 that is pressed against the circumferential surface of the conveyor roller 104 are sent out. The conveyor roller 104 is rotated via a gear array by a sub-scanning motor 107.

A print receiving member 109 is provided that is a sheet guide member that guides the paper sheet 83 sent out from the conveyor roller 104 at the part under the recording head 94 to correspond to an range in which the carriage 93 moves in the main scanning direction. Downstream of the print receiving member 109 in the paper sheet conveying direction, a transfer roller 111 that is rotated to send out the paper sheet 83 in the sheet ejection direction and a spur 112 are provided and, furthermore, paper sheet eject rollers 113 and 114 that send out the paper sheet 83 to the ejected sheet tray 87 and guide members 115 and 116 that form a sheet ejection route are provided.

When recording, the recording head 94 is driven depending on an image signal while moving the carriage 93 so as to eject ink droplets onto the stopped paper sheet 83 to perform recording corresponding to one line, and then the next recording is performed after the paper sheet 83 is conveyed a predetermined distance. Upon receiving a record end signal or a signal informing the arrival of a trailing end of the paper sheet 83 at a record area, recording operation is completed and the paper sheet 83 is ejected.

In a position out of the record area rightward or in a direction in which the carriage 93 moves, a recovery device 117 to recover from ejection failure of the recording head 94 is arranged. The recovery device 117 includes a capping unit, a suction unit, and a cleaning unit. When the carriage 93 is ready and waiting to print, the carriage 93 is moved to the recovery device 117 and the recording head 94 is capped by the capping unit, which keeps the ejection ports wet and thus prevents ejection failure due to drying of the ink. By ejecting the ink not required for recording in the middle of recording, the viscosity of the ink is caused to be uniform at all ejection ports, which maintains a stable ejection performance.

In a case of, for example, occurrence of ejection failure, the capping unit seals the ejection ports (nozzles) of the recording head 94, the suction unit sucks the ink together with bubbles, etc., from the ejection ports via a tube, and the cleaning unit removes the ink, dirt, etc., that are attached to the ejection port surface to recover from the ejection failure. The sucked ink is ejected to a used-ink puddle (not shown) provided on the lower part of the body and is absorbed and stored in the ink absorber in the waste ink reservoir.

As described above, in the inkjet head 10 according to the present embodiment, because the base plate 30, which includes the position reference surfaces 30*a* and 30*b* to perform positioning in the direction parallel to the opening surface 21*a* of the nozzle plate 21, is formed of metal, the accuracy of positioning the inkjet head 10 with respect to the inkjet recording apparatus 50 can be improved. Furthermore, because the housing 40 including the position reference surface 40*a* to perform positioning in the direction perpendicular to the opening surface 21*a* of the nozzle plate 21 is formed of resin, the cost of manufacturing the inkjet head 10 can be reduced. Because the accuracy of positioning the inkjet head 10 with respect to the inkjet recording apparatus 50 can be improved when the inkjet head 10 is attached to the inkjet recording apparatus 50, the quality of an image recorded on a recording paper sheet can thus be improved.

An embodiment of the present invention leads to the effect of an in improvement in the accuracy of positioning a droplet ejection head with respect to a droplet ejection apparatus when the droplet ejection head is attached to the droplet ejection apparatus, an improvement in the image quality, and a reduction in the cost of manufacturing the droplet ejection head.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A droplet ejection head that is attachable to and removable from a droplet ejection apparatus, the droplet ejection head comprising:

a nozzle plate having multiple nozzle holes to eject droplets;

an individual-channel substrate in which multiple individual-liquid-chambers to supply liquid to the nozzle holes are formed, the individual-channel substrate including pressure generating units that apply pressure to liquid in the individual-liquid-chambers;

a common-channel substrate to supply liquid to the individual-channel substrate;

a base plate made of metal and including a first positioning part to be engaged with a part of the droplet ejection apparatus at a given position to perform positioning with respect to the droplet ejection apparatus in a direction along an opening surface of the nozzle plate at which the nozzle holes are opened;

a housing made of resin and including a second positioning part to perform positioning with respect to the droplet ejection apparatus in a direction intersecting with the opening surface and a sealing member extending from a surface of the housing in the direction intersecting with the opening surface; and a plurality of fasteners extending through the base plate and into the sealing member to join the base plate and the housing.

2. The droplet ejection head according to claim 1, wherein the first positioning part is provided in a direction intersecting with a nozzle array in which the nozzle holes are formed, and the first positioning part is provided on a protrusion protruding from an edge of the base plate along the nozzle array.

3. The droplet ejection head according to claim 2, wherein the sealing member includes a protrusion corresponding to the protrusion protruding from the edge of the base plate.

4. The droplet ejection head according to claim 1, wherein, when the droplet ejection head is attached to the droplet ejection apparatus, a side surface of the base plate engages with the part of the droplet ejection apparatus at the given position.

5. The droplet ejection head according to claim 1, wherein the base plate and the common-channel substrate are formed by press molding.

6. The droplet ejection head according to claim 1, wherein the pressure generating unit is an electromechanical conversion element including a lower electrode, a piezoelectric element, and an upper electrode.

7. A method of manufacturing a droplet ejection head that is attachable to and removable from a droplet ejection apparatus and that comprises:

a nozzle plate having multiple nozzle holes to eject droplets;

an individual-channel substrate in which multiple individual-liquid-chambers to supply liquid to the nozzle holes are formed, the individual-channel substrate including pressure generating units that apply pressure to liquid in the individual-liquid-chambers;

a common-channel substrate to supply liquid to the individual-channel substrate;

a base plate made of metal and including a first positioning part to be engaged with a part of the droplet ejection apparatus at a given position to perform positioning with respect to the droplet ejection apparatus in a direction along an opening surface of the nozzle plate at which the nozzle holes are opened;

a housing made of resin and including a second positioning part to perform positioning with respect to the droplet ejection apparatus in a direction intersecting with the opening surface and a sealing member extending from a surface of the housing in the direction intersecting with the opening surface; and a plurality of fasteners, the method comprising:

manufacturing a first head structure by optically aligning and joining the nozzle plate and the individual-channel substrate;

manufacturing a second head structure by aligning, using an opening provided in the common-channel substrate and the base plate, and joining the common-channel substrate and the base plate;

optically aligning and joining the first head structure and the second head structure; and extending the plurality of fasteners through the base plate of the second head structure joined to the first head structure into the sealing member to join the base plate and the housing.

8. A droplet ejection apparatus comprising an attachable and removable droplet ejection head, wherein the droplet ejection head comprises:

a nozzle plate having multiple nozzle holes to eject droplets;

an individual-channel substrate in which multiple individual-liquid-chambers to supply liquid to the nozzle holes are formed, the individual-channel substrate including pressure generating units that apply pressure to liquid in the individual-liquid-chambers;

a common-channel substrate to supply liquid to the individual-channel substrate;

a base plate made of metal and including a first positioning part to be engaged with a part of the droplet ejection apparatus at a given position to perform positioning with respect to the droplet ejection apparatus in a direction along an opening surface of the nozzle plate at which the nozzle holes are opened;

a housing made of resin and including a second positioning part to perform positioning with respect to the droplet ejection apparatus in a direction intersecting with the opening surface and a sealing member extending from a surface of the housing in the direction intersecting with the opening surface; and a plurality of fasteners extending through the base plate and into the sealing member to join the base plate and the housing.

* * * * *